US009246260B2

(12) United States Patent
Naganawa et al.

(10) Patent No.: US 9,246,260 B2
(45) Date of Patent: Jan. 26, 2016

(54) ELECTRICAL CONNECTOR

(71) Applicant: J.S.T. MFG. CO., LTD., Osaka-shi (JP)

(72) Inventors: Masato Naganawa, Osaka (JP); Yuki Maeta, Osaka (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 0 days.

(21) Appl. No.: 14/314,234

(22) Filed: Jun. 25, 2014

(65) Prior Publication Data

US 2015/0004844 A1 Jan. 1, 2015

(30) Foreign Application Priority Data

Jun. 27, 2013 (JP) ..... 2013-134879

(51) Int. Cl.

| | |
|---|---|
| ***H01R 13/64*** | (2006.01) |
| ***H01R 13/516*** | (2006.01) |
| ***H01R 13/639*** | (2006.01) |
| *H01R 12/75* | (2011.01) |

(52) U.S. Cl.

CPC ..... *H01R 13/516* (2013.01); *H01R 13/639* (2013.01); *H01R 12/75* (2013.01)

(58) Field of Classification Search

CPC ..... H01R 13/629; H01R 13/631; H01R 13/6315; H01R 13/64; H01R 13/62933

USPC ..... 439/376, 326, 342

See application file for complete search history.

(56) References Cited

U.S. PATENT DOCUMENTS

| | | | | |
|---|---|---|---|---|
| 7,828,585 | B2 * | 11/2010 | Kurimoto | 439/468 |
| 8,011,944 | B2 | 9/2011 | Umehara | |
| 2011/0306229 | A1 * | 12/2011 | Katsui et al. | 439/345 |

FOREIGN PATENT DOCUMENTS

| | | | |
|---|---|---|---|
| EP | 2 242 148 | A1 | 10/2010 |
| JP | 2013-4244 | A | 1/2013 |
| JP | 2013-26159 | A | 2/2013 |
| JP | 2013-26159 | A1 | 2/2013 |

OTHER PUBLICATIONS

Extended European Search Report dated Oct. 30, 2014 for corresponding European Patent Application No. 14174070.4.

* cited by examiner

*Primary Examiner* — Phuong Dinh

(74) *Attorney, Agent, or Firm* — Kratz, Quintos & Hanson, LLP

(57) ABSTRACT

An electrical connector includes a base including a base housing, and a socket including a socket housing. Each of two socket side walls of the socket housing is provided with a first protrusion, and a distance L4 between two base side walls is equal to or larger than a distance L2 between the respective leading ends of the first protrusions. Each of two base side walls is provided with a first engagement projection on its inner surface, and a distance L1 between the respective leading ends of the first engagement projections is smaller than the distance L2 between the respective leading ends of the first protrusions, and the distance L1 is equal to or larger than a distance L3 between the two socket side walls. While the socket is completely accommodated in a socket accommodation chamber, each first protrusion is positioned below the corresponding first engagement projection.

5 Claims, 8 Drawing Sheets

ELECTRICAL CONNECTOR

CROSS REFERENCE TO RELATED APPLICATION

The present application claims priority from Japanese Patent Application No. 2013-134879, which was filed on Jun. 27, 2013, the disclosure of which is herein incorporated by reference in its entirety.

BACKGROUND OF THE INVENTION

1. Field of the Invention

The present invention relates to an electrical connector including: a base configured to be mounted on a substrate; and a socket configured to hold an electric wire.

2. Description of the Related Art

Patent Literature 1 discloses an electrical connector including a first connector (a base) and a second connector (a socket), which electrical connector does not require a slider for locking and therefore has a smaller number of parts. In the electrical connector of Patent Literature 1, the first connector is mated with the second connector as follows. First, projections respectively provided on side surfaces of the second connector are respectively fitted in communication grooves provided on side walls of the first connecter, and then the second connector is moved in a thickness direction, i.e., downward, thereby conducting a first mating. Thereafter, the second connector is moved toward an operator in a depth direction, to cause the projections to be moved along the recesses provided on the side walls of the first connector, thereby conducting a second mating. After the second mating, walls defining the recesses prevent the second connector from moving in the thickness direction.

CITATION LIST

Patent Literature 1: Japanese Unexamined Patent Publication No. 26159/2013 (Tokukai 2013-26159)

SUMMARY OF THE INVENTION

In the electrical connector described in Patent Literature 1, there is a 90 degree difference in the direction of the movement of the second, connector between the first and second matings as described above. Therefore, it is hard to say that the electrical connector has good mating workability, and there is a disadvantage that a relatively longer time is needed for the mating process and/or it is more likely that a failure occurs in the mating process.

An object of the present invention is to provide an electrical connector providing good workability in mating of a socket with a base.

An electrical connector of the present invention includes: a base including a base housing which is configured to be mounted on a substrate and is made of an insulating material, and a base contact attached to the base housing; and a socket, including a socket housing made of an insulating material, and a socket contact attached to the socket housing. The socket housing includes two socket side walls parallel to each other, each of which walls extends in one direction, and the socket housing is configured to hold an electric wire so that the electric wire connected to the socket contact comes out of a rear end of the socket housing in the one direction. The base housing includes: two base side walls parallel to each other, each of which walls is orthogonal to the substrate and extends in the one direction; and a socket accommodation chamber formed between the two base side walls and opening rearward and upward, which is a direction away from the substrate, to accommodate the socket. Each of the two socket side walls of the socket housing is provided with a first protrusion, and a distance between the two base side walls is equal to or larger than a distance between respective leading ends of the first protrusions. Each of the two base side walls is provided with, on its inner surface, a first engagement projection, and a distance between respective leading ends of the first engagement projections is smaller than the distance between the respective leading ends of the first protrusions and is equal to or larger than a distance between the two socket side walls. The electrical connector is configured so that after the socket is inserted into the socket accommodation chamber from above with the first protrusions positioned forward of the first engagement projections, to be partially accommodated in the socket accommodation chamber while being inclined with respect to the substrate, the socket is moved rearward until each first protrusion is positioned below the corresponding first engagement projection, and then the socket is displaced in a direction in which a front end of the socket is moved downward, thereby causing the socket to be completely accommodated in the socket accommodation chamber and establishing electrical connection between the socket contact and the base contact.

In the electrical connector of the present invention, the process of mating the socket with the base is completed merely by: pulling the electric wire rearward to move the socket while being guided by the base side walls; and then moving the front end of the socket downward. Therefore, the electrical connector has good mating workability. Further, in a mated state, the first protrusion provided on each socket side wall is positioned below the corresponding first engagement projection formed on each base side wall. Therefore, even if the electric wire is displaced upward, it is less likely that the socket is undated. Thus, the resistance to the placement of the electric wire is improved. Furthermore, instead of the configuration such that as the socket is moved downward, each first protrusion rides over the corresponding first engagement projection and then, is positioned below the first engagement projection, the electrical connector is configured so that each first protrusion is positioned below the corresponding first engagement projection by moving rearward the socket inclined with respect to the substrate. This allows each first engagement projection to have a larger thickness in the up/down directions, which further improves the resistance to the placement of the electric wire.

It is preferable that each of the two socket side walls is provided with an abutting surface configured to be brought into contact with a corresponding one of frontward-facing surfaces of the base side walls when the socket partially accommodated in the socket accommodation chamber while being inclined with respect to the substrate is moved rearward until each first protrusion is positioned below the corresponding first engagement projection. With this, when the abutting surfaces are respectively brought into contact with the frontward-facing surfaces of the base side walls, it is the time to stop pulling the electric wire rearward and to start moving the front end of the socket downward. This further improves workability in the mating process.

It is preferable that: each of the two socket side walls is provided with a second protrusion located forward of the first protrusion, and each of the two base side walls is provided with, on its inner surface, a second engagement projection located forward of the first engagement projection; and the electrical connector is configured so that, when the socket is displaced in the direction in which, the front end of the socket is moved downward, each second protrusion rides over the corresponding second engagement projection, thereby causing each second protrusion to be positioned below the corresponding second engagement projection while the socket is completely accommodated in the socket accommodation chamber. With this, at a portion near the front end of the socket, improved is the ability to maintain the socket mated with respect to a direction in which the two socket side walls oppose each other (in right/left directions).

In the above case, it is preferable that: each of the inner surfaces of the two base side walls includes a rear region on which the first engagement projection is formed, and a front region on which the second engagement projection is formed, the front region being recessed relative to the rear region; each of the two socket side walls is provided with a ridge located forward of the first protrusion, and the second protrusion is formed on a surface of the ridge which surface opposes the corresponding one of the base side walls and a third protrusion is formed on a rearward-facing surface of the ridge; a third engagement projection is formed on a frontward-facing surface provided at a front end of the rear region; and the electrical connector is configured so that, when the socket is displaced in the direction in which the front end of the socket is moved downward, each third protrusion rides over the corresponding third engagement projection, thereby causing each third protrusion to be positioned below the corresponding third engagement projection while the socket is completely accommodated in the socket accommodation chamber. With this, at the portion near the front end of the socket, improved is the ability to maintain the socket mated with respect to a direction in which the electric wire comes out.

Further, it is preferable that: a reinforcing metal fitting configured to be used to mount the base on the substrate is attached to each of the two base side walls; and an engagement area, which is an area where each first protrusion is brought into contact with the corresponding first engagement projection, at least partially overlaps a substrate-facing area of the reinforcing metal fitting with respect to front/rear directions. With this, even if the electric wire is displaced upward, it is less likely that the base housing is warped. This prevents the first engagement projection(s) or the first protrusion(s) from being deformed or broken by a force smaller than the strength of the soldering connection of the reinforcing metal fittings. This consequently prevents the electric wire from being easily released by deformation of the socket housing or the base housing, thereby further improving the resistance to the placement of the electric wire.

BRIEF DESCRIPTION OF THE DRAWINGS

Other and further objects, features and advantages of the invention will appear more fully from the following description taken in connection with the accompanying drawings in which:

FIG. 4A is a perspective view of a base included in the electrical connector shown in FIG. 1, and.

DESCRIPTION OF THE PREFERRED EMBODIMENT

Figure 1:
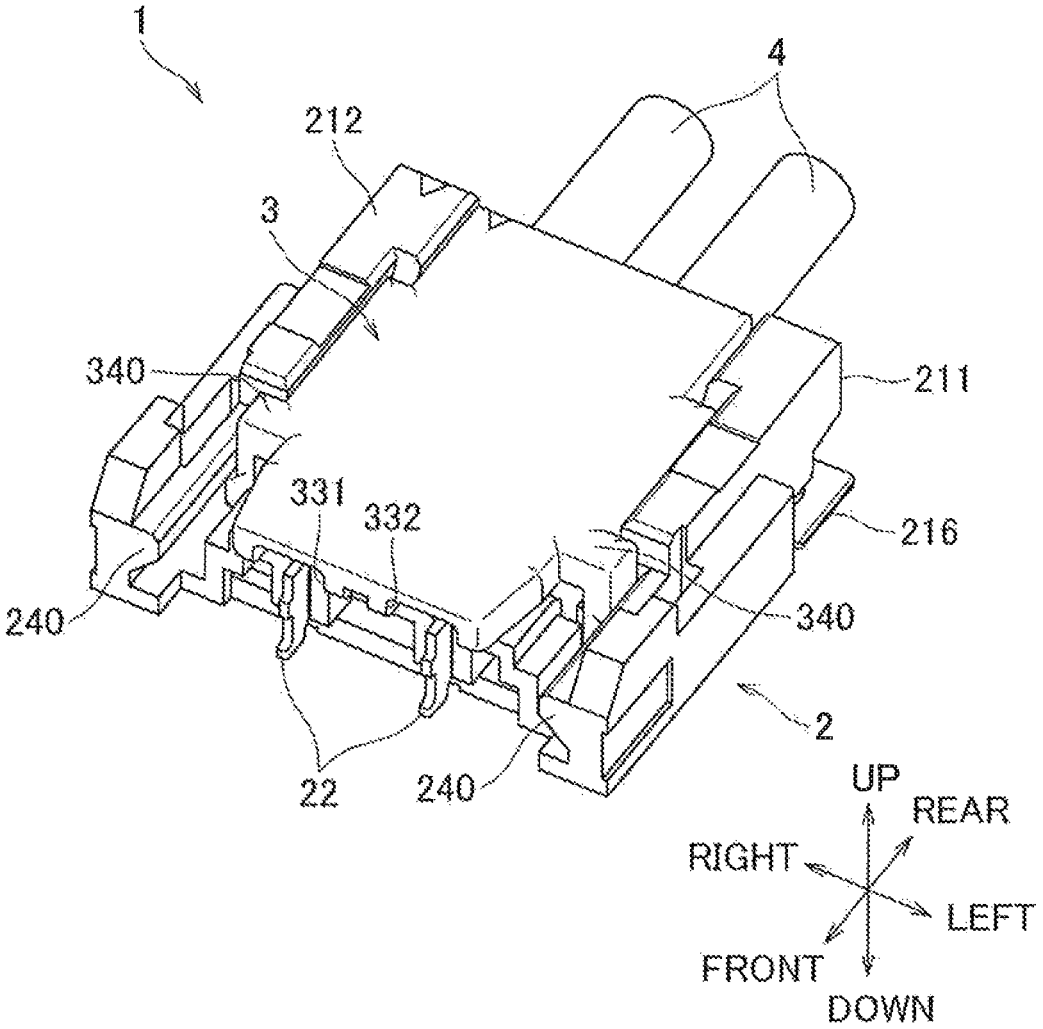
FIG. 1 is a perspective view of an electrical connector of an embodiment of the present invention.

The following describes a preferred embodiment of the present invention, with reference to the drawings. As shown in FIG. 1, an electrical connector 1 of this embodiment includes: a base 2 configured to be mounted on a not-shown substrate; and a socket 3 configured to be mated with the base 2. The socket 3 holds two electric wires 4. The base 2 is provided with two base contacts 22 while the socket 3 is provided with two socket contacts 32 (see FIG. 3). In the mated state, the base contacts 22 are respectively in contact with the socket contacts 32, to establish electrical connections therebetween. Further, as described later, the electrical connector 1 of this embodiment includes locking mechanisms configured to lock the socket 3 onto the base at six points in the mated state.

Now, description will be given for the definition of the directions in this embodiment. As shown in FIG. 1, of directions orthogonal to the substrate, a direction from the substrate toward the electrical connector 1 is defined as an up direction, and the direction opposite to the up direction is defined as a down direction. A direction in which the electric wires 4 come out of the socket 3 is defined as a rear direction and the direction opposite to the rear direction is defined as a front direction. With reference to the up/down directions and the front/rear directions, right and left directions are defined.

Then, the socket 3 will be described further with reference to FIGS. 2A, 2B, and 3. The socket 3 includes: a socket housing 31 made of an insulating material; and the two socket contacts 32 attached to the socket housing 31 so as to be arranged side by side in the right/left directions (a width direction). As shown in FIG. 3, each socket contact 32 is connected with the corresponding electrical wire 4. To be more specific, each socket contact 32 has two pairs of grips 32*a* and 32*b*, and the grips 32*a* and 32*b* are respectively secured onto a jacketed region and a center core region of the corresponding electric wire 4 through crimp connection. Forward of the two pairs of grips 32*a* and 32*b*, a connection portion 32*c* is formed through bending processing. The connection portion 32*c* has a pair of U-shape regions 32*c*and 32*c*2 each having a substantially U-shape section on a plane orthogonal to the front/rear directions. Each of the U-shape regions 32*c*1 and 32*c*2 is formed so as to project downward. The pair of U-shape regions 32*c*1 and 32*c*2 are arranged side by side in the right/left directions while contacting each other. As described later, each base contact 22 is resiliently gripped by the corresponding pair of U-shape regions 32*c*1 and 32*c*2, to establish an electrical connection therebetween.

Note that each socket contact 32 may be configured to secure the electric wire through any other manners than the crimping connection, for example, through insulation-displacement connection, insulation-piercing connection, or the like. As the electrical wires, shielded cables such as coaxial cables, or flexible flat cables may be used, for example.

In the socket housing 31, there is formed an electric wire accommodation chamber (not shown) in which the two electrical wires 4 are held. The two electrical wires 4 held in the electric wire accommodation chamber come rearward out of openings 31*a* and 31*b* provided at a rear end of the socket housing 31 so that the wires 4 are arranged side by side in the right/left directions. The socket housing 31 has slits (not shown) each formed so as to extend from a lower surface to a front surface of the socket, housing 31 to expose a portion between the corresponding pair of U-shape regions 32*c*1 and 32*c*2.

Figure 2A:
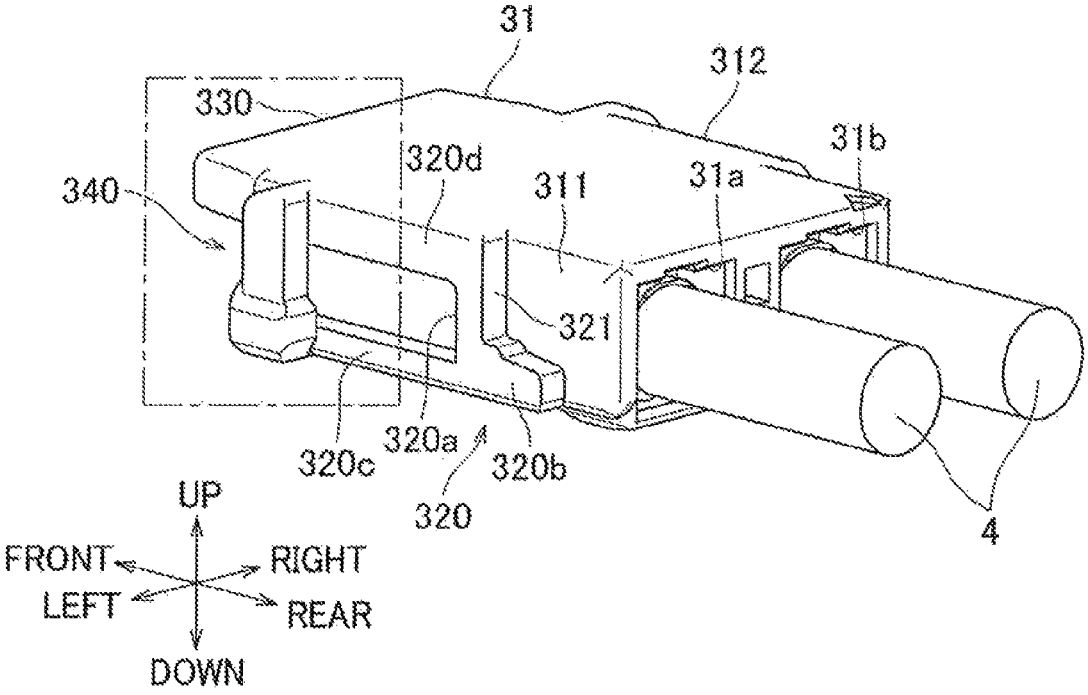
FIG 2A is a perspective view of a socket included in the electrical connector shown in FIG. 1.
Figure 3:
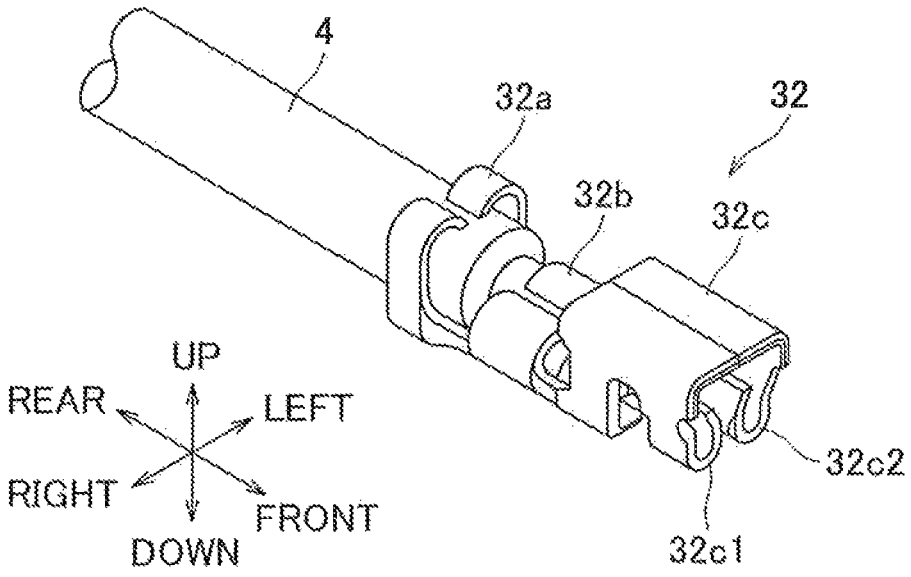
FIG. 3 is a perspective view or a socket contact and an electric wire connected to the socket contact.

As shown in FIG. 2A, the socket housing 31 includes two socket side walls 311 and 312 parallel to each other, each of which side walls is orthogonal to the substrate and extends in the front/rear directions. Each of the two socket side walls 311 and 312 is provided with a side protrusion 320. The side protrusion 320 includes: a vertical protrusion 320*a* extending in the up/down directions with its length the same as the thickness of the socket housing 31 in the up/down directions; a lower rear protrusion (a first protrusion) 320*b* extending rearward from a lower portion of the vertical protrusion 320*a*; a lower front protrusion 320*c* extending frontward from the lower portion of the vertical protrusion 320*a;* and an upper front protrusion 320*d* extending frontward from an upper portion of the vertical protrusion 320*a* in parallel with the lower front protrusion 320*c*. The thickness of the lower rear protrusion 320*b* in the up/down directions decreases toward the rear direction, and a top surface of the lower rear protrusion 320*b* is inclined down toward the rear direction. The vertical protrusion 320*a* has a rearward-facing surface 321 orthogonal to the socket side walls 311 and 312.

The socket housing 31 is provided with, on an upper portion of its front surface, a front protrusion 330 which protrudes frontward and is located forward of the respective front ends of the socket side walls 311 and 312. The front protrusion 330 has, on its under surface, two grooves 331 and 332 (see FIG. 1) formed at the respective positions corresponding to two covering projections 215 (see FIG. 4A) of the base housing 21, which will be described later. The grooves 331 and 332 are configured to respectively receive the covering projections 215 in the mated state.

Each of the two socket side walls 311 and 312 is provided with a ridge 340 extending in the up/down directions with its length the same as the thickness of the socket housing 31 in the up/down directions. In this embodiment, the ridge 340 is provided near the front end of the side protrusion 320 so as to extend over the lower front protrusion 320*c* and the upper front protrusion 320*d*. That is, the ridge 340 is provided forward of the lower rear protrusion 320*b*.

Figure 2B:
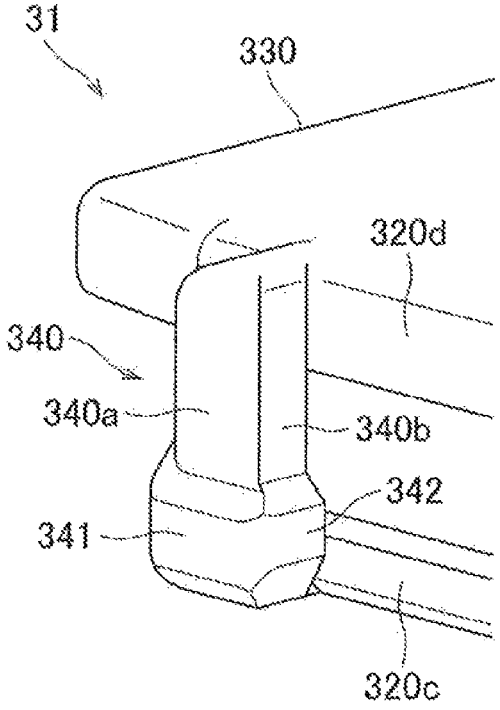
FIG. 2B is an enlarged view of a part of the socket.

As shown in FIG. 2B, each ridge 340 is provided with a ridge leading end protrusion (a second protrusion) 341 on a lower portion of a leading end surface (a surface to oppose the corresponding base side wall 211, 212) 340*a* of the ridge 340. Note that the "leading end" herein refers to an end in a direction in which a protrusion/projection/ridge protrudes. Each ridge 340 is further provided with a ridge rear protrusion (a third protrusion) 342 on a lower portion of a rear side surface (a rearward-facing surface) 340*b* of the ridge 340. The entire upper and lower surfaces of the ridge leading end protrusion 341 and the ridge rear protrusion 342 are all sloping surfaces. In this embodiment, the ridge leading end protrusion 341 and the ridge rear protrusion 342 are continuous with each other.

Figure 4A:
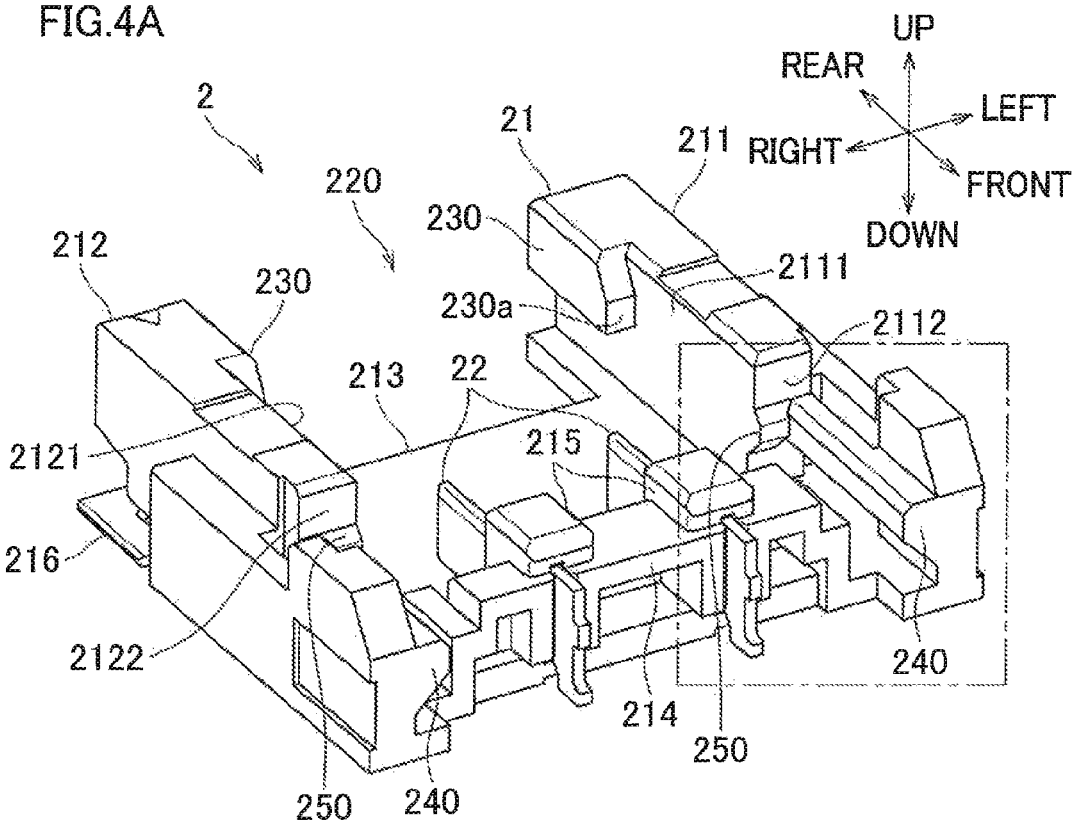

Now, the base 2 will be described further with reference to FIGS. 4A, 4B, and 5. As shown in FIG. 4A, the base 2 includes: a base housing 21 which is configured to be mounted on the substrate and made of an insulating material; and the two base contacts 22 attached to the base housing 21 so as to be arranged side by side in the right/left directions.

The base housing 21 includes; two base side walls 211 and 212 parallel to each other, each of which side walls is orthogonal to the substrate and extends in the front/rear directions; a base bottom wall 213; and a base front wall 214. The base bottom wall 213 is formed into a flat plate-like member parallel to the substrate, and coupled to the respective under surfaces of the two base side walls 211 and 212. The base front wall 214 is provided so as to protrude upward from a front end portion of the base bottom wall 213, and is slightly separated from the two base side walls 211 and 212. To the base front wall 214, the two base contacts 22 are attached. Each of the two base contacts 22 is formed into a flat plate-like member orthogonal to the substrate. Each base contact 22 is inserted, from the front, into a through hole (not shown) formed through the base front wall 214, and a portion of each contact 22 which portion thus protrudes from the base front wall 214 extends rearward above the base bottom wall 213.

The base front wall 214 is provided with two covering projections 215 positioned so as to respectively cover the two base contacts 22 from above. Further, to a portion near a rear end of each of the base side walls 211 and 212, an L-shape reinforcing metal fitting 216 is attached. Each L-shape metal reinforcing metal fitting 216 is press-fitted into a not-shown slit which opens to a lower end and the rear end of the corresponding base side wall 211, 212. Each reinforcing metal fitting 216 attached to the base housing 21 includes: a portion parallel to the substrate and to be soldered to the substrate (a substrate-facing area); and a portion orthogonal to the substrate and press-fitted into the corresponding slit. The substrate-facing area extends outward in the right/left directions from a lower end of the portion orthogonal to the substrate, and an outer end of the substrate-facing area is located outward of the corresponding base side wall 211, 212. The base 2 is mounted on the substrate through soldering connection at four points, that is, at the substrate-facing areas of the reinforcing metal fittings 216 and portions near the respective front ends of the two base contacts 22. The entire substrate-facing area of each reinforcing metal fitting 216 is soldered to the substrate, that is, each substrate-facing area is soldered to the substrate throughout its entire length in the front/rear directions and its entire breadth in the right/left directions. Each reinforcing metal fitting 216 partially overlaps a corresponding base rear projection 230, which will be described later, with respect to the front/rear directions.

Between the two base side walls 211 and 212 and above the base bottom wall 213, there is formed a socket accommodation chamber 220 configured to accommodate the socket 3. The socket accommodation chamber 220 opens rearward and upward.

The two base side walls 211 and 212 are respectively provided with base rear projections (first engagement projections) 230 formed on upper portions of the inner surfaces 2111 and 2121 which portions are near the rear end. Each base rear projection 230 has the thickness in the up/down directions which is approximately a half of the height of each of the base side walls 211 and 212 in the up/down directions. An under surface of each base rear projection 230 is a horizontal surface. A front end surface 230*a* of each base rear projection 230 is a vertical surface orthogonal to the front/rear directions.

Figure 5:
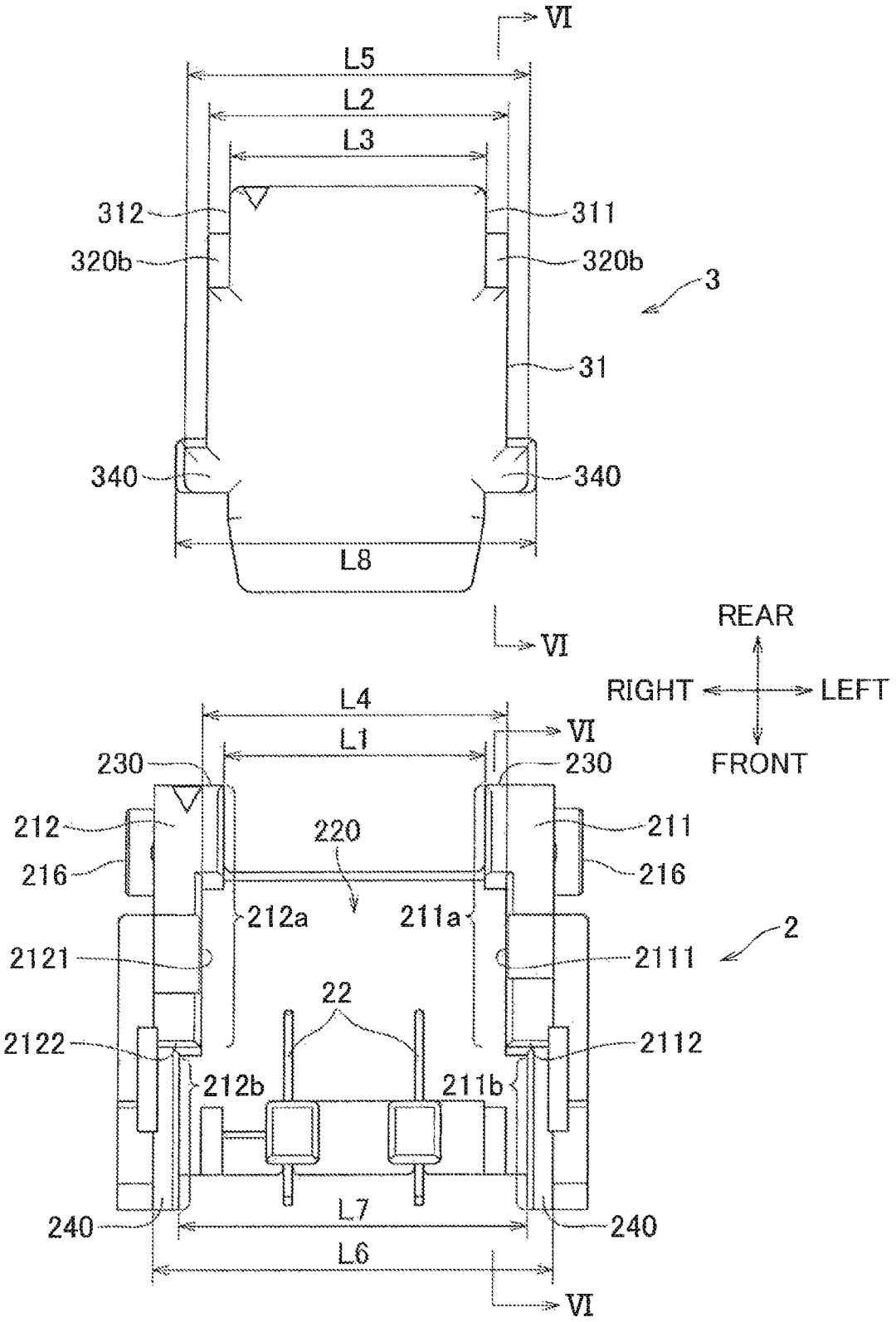
FIG. 5 is a plan view of the socket and the base which are in a separated state.

As shown in FIG. 5, the inner surfaces 2111 and 2121 of the two base side walls 211 and 212 respectively has: rear regions 211*a* and 212*a* on which the base rear projections 230 are respectively formed; and front regions 211*b* and 212*b* which are recessed relative to the rear regions 211*a* and 212*a* (that is, the front regions 211*b* and 212*b* are more distant from each other in the right/left directions than the rear regions 211*a* and 212*a*). Thus, at the respective front ends of the rear regions

211*a* and 212*a*, there are respectively formed frontward-facing surfaces 2112 and 2122 orthogonal to the substrate.

Figure 4B:
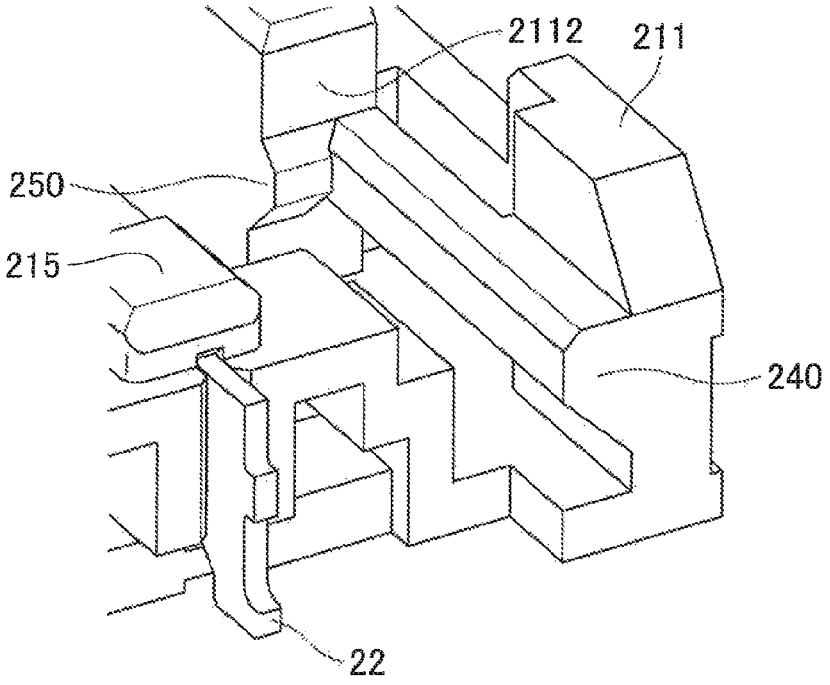
FIG. 4B is an enlarged view of a part of the base.

As shown, in FIGS. 1 and 4B, base front projections (second engagement projections) 240 are respectively formed on the front regions 211*b* and 212*b* of the inner surfaces 2111 and 2121 of the two base side walls 211 and 212. Each base front projection 240 is formed so as to extend throughout the entire length of the corresponding front region 211*b*, 212*b* in the front/rear directions. The entire under surface of each base front projection 240 is a sloping surface. The top surface of each base front projection 240 partially slopes, that is, a portion thereof close to the leading end of the projection is a sloping surface.

As shown in FIG. 4B, on the frontward-facing surface 2112 which is provided at the front end of the rear region 211*a* and orthogonal to the substrate, there is formed a base middle projection (a third engagement, projection) 250. Also on the frontward-facing surface 2122 which is provided at the front end of the rear region 212*a* and orthogonal to the substrate, there is formed a counterpart base middle projection (a third engagement projection) 250. Each base middle projection 250 is formed in the vicinity of an inner end of the corresponding surface 2112, 2122 in the right/left directions. The entire top surface and the entire under surface of each base middle projection 250 are both sloping surfaces.

Now, description will be given for the relationship of the size between the base 2 and the socket 3. As shown in FIG. 5, a distance L1 between the respective leading ends of the two base rear projections 230 is smaller than a distance L2 between the respective leading ends of the two lower rear protrusions 320*b*, and the distance L1 is equal to or larger than a distance L3 between the respective outer surfaces of the two socket side walls 311 and 312. Further, a distance L4 between the two base side walls 211 and 212 is equal to or larger than the distance L2 between the respective leading ends of the two lower rear protrusions 320*b*. That is, the relationship among the distances L1 to L4 is $L3 \leq L1 < L2 \leq L4$. Note that the reason for $L1 < L2$ instead of $L1 \leq L2$ is that the base rear projections 230 have to be engaged with the lower rear protrusions 320*b*, respectively. Further, a distance L5 between the respective leading end surfaces of the two ridges 340 is larger than a distance between the two rear regions 211*a* and 212*a* (i.e., the distance L4 between the two base side walls 211 and 212), and the distance L5 is smaller than a distance L7 between the respective leading ends of the two base front projections 240 (the distance L7 is smaller than a distance L6 between the two front regions 211*b* and 212*b*) ($L4 < L5 < L7 < L6$). Furthermore, the distance L7 between the respective leading ends of the two base front projections 240 is slightly smaller than a distance L8 between the respective leading ends of the two ridge leading end protrusions 341 ($L7 < L8$).

As will be described later, in the mated state, the lower rear protrusions 320*b* are respectively positioned below the base rear projections 230. However, as described above, the distance L1 between the respective leading ends of the two base rear projections 230 is smaller than the distance L2 between the respective leading ends of the two lower rear protrusions 320*b* and the thickness of each base rear projection 230 in the up/down directions is large. Therefore, it is not possible to insert the socket 3 into the socket accommodation chamber 220 merely by moving the socket 3 downward along the direction orthogonal to the substrate. Meanwhile, the distance L2 between the respective leading ends of the two lower rear protrusions 320*b* is equal to or smaller than the distance L4 between the two base side walls 211 and 212, and the distance L1 between the respective leading ends of the two base rear projections 230 is equal to or larger than the distance L3 between the respective outer surfaces of the two socket side walls 311 and 312. Taking advantage of this, in the electrical connector 1 of this embodiment, the socket 3 is inserted to be accommodated in the socket accommodation chamber 220, through the following procedure.

Figure 6A:
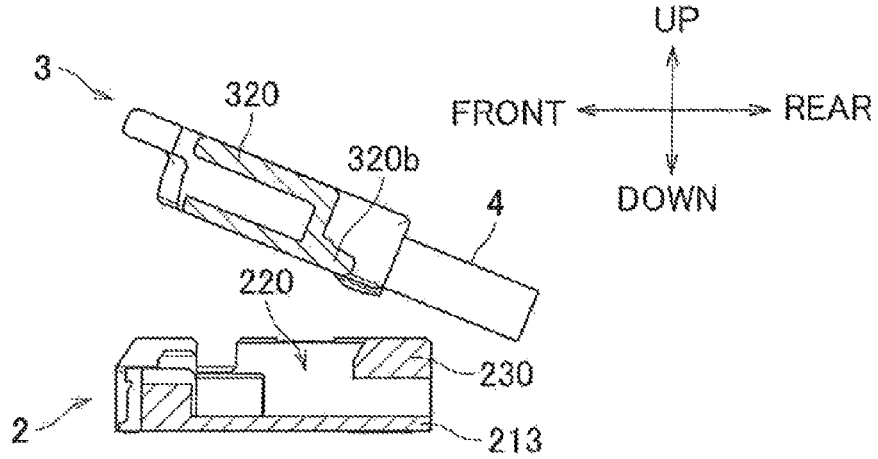
FIGS. 6A to 6D are sectional views sequentially showing a process of mating the socket with the base.

First, as shown in FIG. 6A, the socket 3 is positioned above the base 2. At this time, the socket 3 is inclined so that the rear end of the socket 3 is positioned lower than the front end thereof. Note that each of FIGS. 6A to 6D shows the section of the base 2 and socket 3 taken along a line VI-VI of FIG. 5.

Figure 6B:
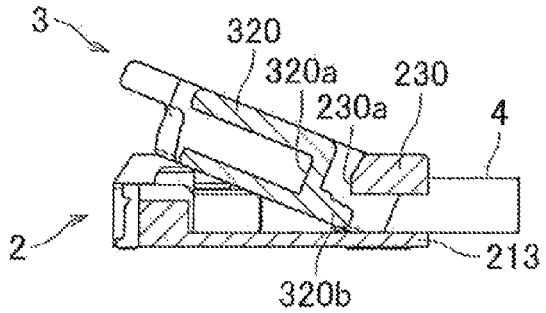

Then, the socket 3 is lowered to be partially inserted into the socket accommodation chamber 220 from above with the lower rear protrusions 320*b* positioned forward of the base rear projections 230, as shown in FIG. 6B. This insertion is possible because there is the relationship of $L3 \leq L1$ and $L2 \leq L4$, as described above. After this insertion, the lower rear protrusions 320*b* are in contact with the base bottom wall 213, and positioned slightly forward of the respective base rear projections 230. In addition, portions of the socket side walls 311 and 312 which portions are located rearward of the respective lower rear protrusions 320*b* are sandwiched by the base rear projections 230. The above operation is easy since it is possible for an operator to move the socket 3 by holding and moving the electrical wires 4.

Figure 6C:
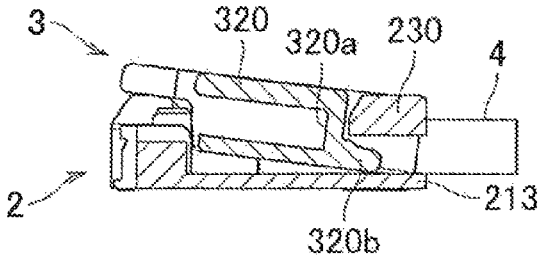

Subsequently, as shown in FIG. 6C, the operator pulls the electrical wires 4 rearward, thereby to move the socket 3 rearward until the lower rear protrusions 320*b* are respectively positioned below the base rear projections 230 while causing the socket 3 to be guided by the base side walls 211 and 212. In the state shown in FIG. 6C, an angle at which the socket 3 is inclined with respect to the substrate is smaller than in the state shown in the FIG. 6B. Due to the above-described relationship of $L1 < L2$, the lower rear protrusions 320*b* are respectively covered with the base rear projections 230 in a plan view, and the lower rear protrusions 320*b* vertically overlap the base rear projections 230, respectively.

At this time, due to the above-described relationship of $L4 < L5 < L7$, the rear side surfaces 340*b* of the ridges 340 are respectively brought into contact with the frontward-facing surfaces 2112 and 2122 of the rear regions 211*a* and 212*a*. Therefore, even if the electrical wires 4 are further pulled rearward in the state shown in FIG. 6C, the socket 3 is not moved, and the socket 3 is not completely accommodated in the socket accommodation chamber 220.

Further, in this state, due to the relationship of $L7 < L8$, the ridge leading end protrusions 341 are respectively located higher than the base front projections 240, and the sloping under surfaces of the ridge leading end protrusions 341 and the ridge rear protrusions 342 of the ridges 340 are respectively in contact with the sloping top surfaces of the base front projections 240 and the base middle projections 250.

Figure 6D:
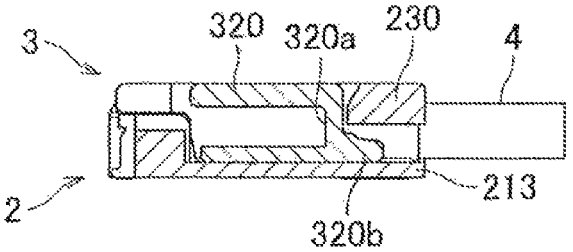

Then, as shown in FIG. 6D, an operator forcibly presses down a portion of the socket 3 which portion is near the front end thereof, to displace the socket 3 so that the front end of the socket 3 is moved downward without displacing the rear end of the socket 3 in the up/down directions. As a result, each ridge leading end protrusion 341 and each ridge rear protrusion 342 respectively ride over the corresponding base front projection 240 and the corresponding base middle projection 250. Thus, the socket 3 is completely accommodated in the socket accommodation chamber 220, and each base contact 22 is resiliently gripped by the corresponding pair of U-shape regions 32*c*1 and 32*c*2, and thereby each socket contact 32 is electrically connected with the corresponding base contact 22.

As described above, the distance L7 between the respective leading ends of the two base front projections 240 is slightly smaller than the distance L8 between the respective leading ends of the two ridge leading end protrusions 341 (L7<L8). However, as described above, the under surfaces of the ridge leading end protrusions 341 and the ridge rear protrusions 342, and the top surfaces of the base front projections 240 and the base middle projections 250 are sloping surfaces. Therefore, when the front end of the socket 3 is moved downward, the base side walls 211 and 212 pressed by the ridge leading end protrusions 341 and the ridge rear protrusions 342 are elastically deformed outwardly, and this enables each ridge leading end protrusion 341 and each ridge rear protrusion 342 to ride over the corresponding base front projection 240 and the corresponding base middle projection 250, respectively.

Through the above described procedure, mating of the socket 3 with the base 2 is completed. As described above, in the electrical connector 1 of this embodiment, the process of mating the socket 3 with the base 2 is completed merely by: pulling the electric wires 4 rearward to move the socket 3 while being guided by the base side walls 211 and 212; and then moving the front end of the socket 3 downward. This overcomes a disadvantage of the conventional art in which there is a 90 degree difference in the direction of the movement of the socket, leading to good mating workability. This relatively shortens the amount of time needed to complete the mating process, and decreases the possibility that a failure occurs in the mating process. Moreover, in this embodiment, it is easy to recognize when to stop pulling the electrical wires 4 rearward and to start moving the front end of the socket 3 downward. That is, when the rear side surfaces 340*b* of the ridges 340 are respectively brought into contact with the frontward-facing surfaces 2112 and 2122 of the rear regions 211*a* and 212*a*, it is the time to stop pulling the electrical wires 4 rear-ward and to start moving the front end of the socket 3 downward. This further improves workability in the mating process.

Figure 7:
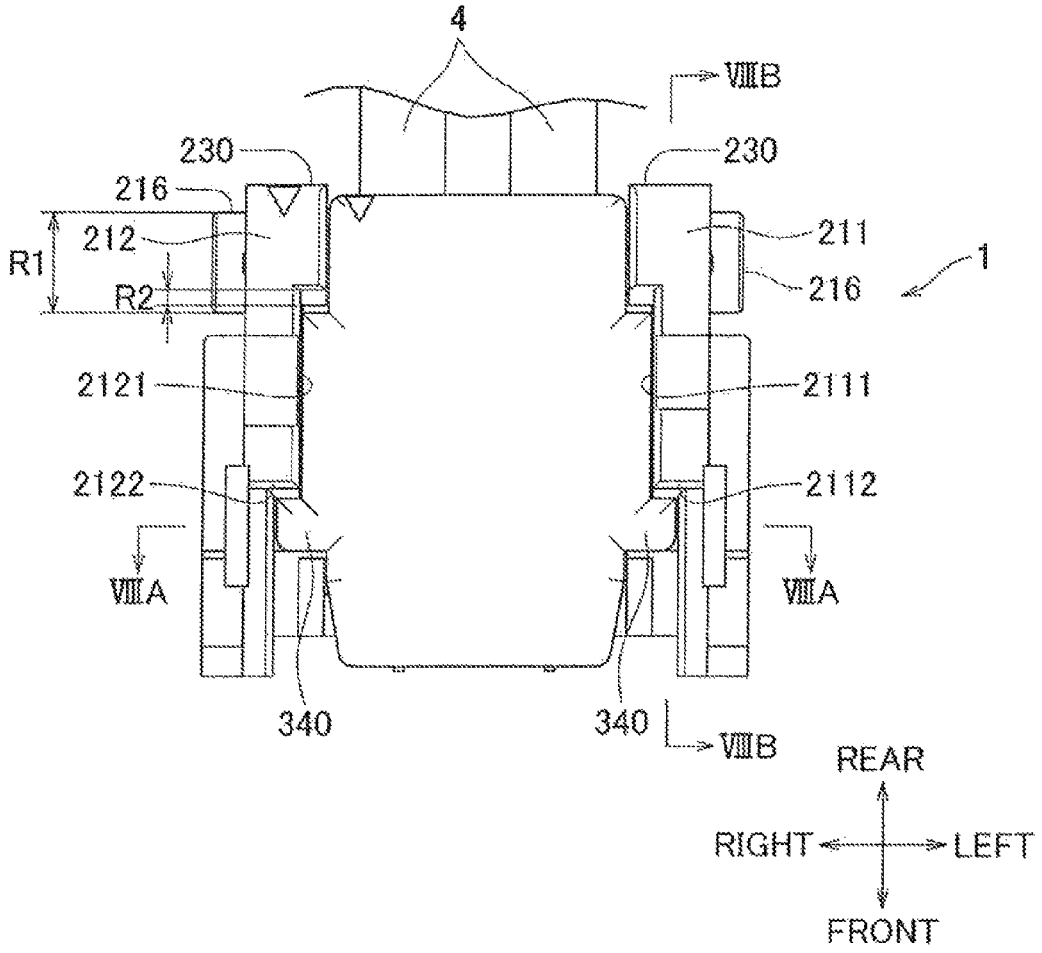
FIG. 7 Is a plan view of the socket and the base which are in a mated state.
Figure 8A:
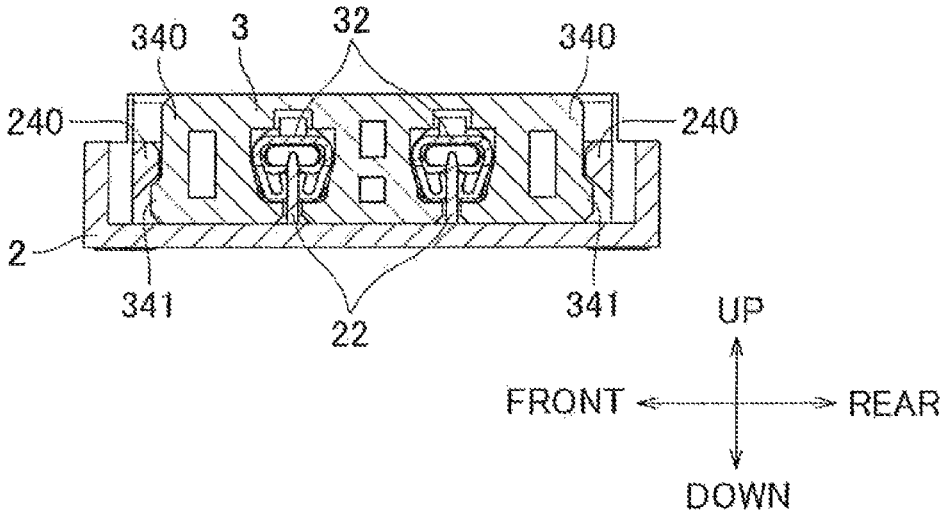
FIGS. 8A and 8B. are sectional views of the socket and the base which are in the abated state, respectively taken along a line VIIIA-VIIIA and a line VIIIB-VIIIB shown in FIG. 7.
Figure 8B:
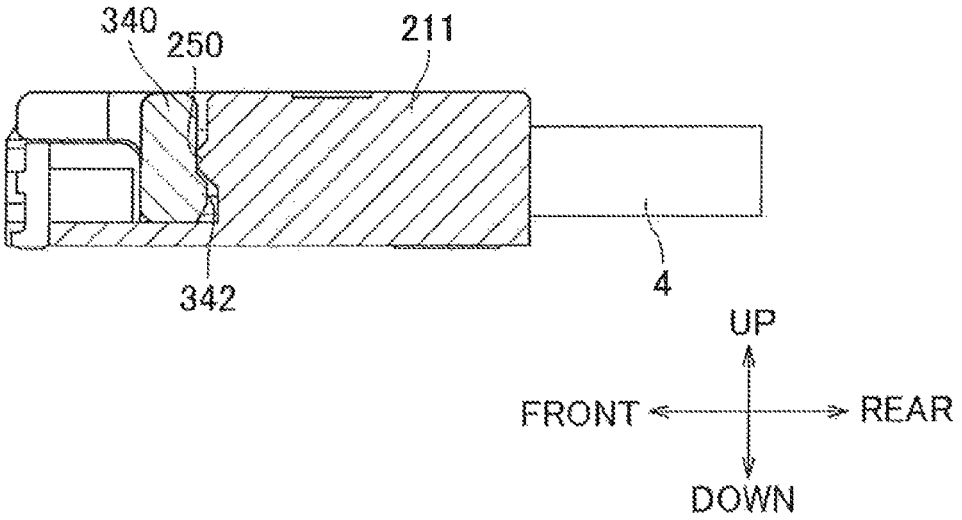

As shown in FIGS. 7, 8A, and 8B, in the mated state, the socket 3 is accommodated in the socket accommodation chamber 220, and the socket contacts 32 are electrically connected with the base contacts 22, respectively. Note that FIG. 8A is a sectional view taken along a line VIIIA-VIIIA of FIG. 7, and FIG. 8B is a sectional view taken along a line VIIIB-VIIIB of FIG. 7.

As shown in FIG. 6D, in the mated state, the lower rear protrusions 320*b* provided on the socket side walls 311 and 312 are respectively positioned below the base rear projections 230 provided on the base side walls 211 and 212, with some distance therebetween. Therefore, even if the electrical wires 4 are displaced upward to move the rear end of the socket 3 upward, the lower rear protrusions 320*b* are respectively engaged with the base rear projections 230 to function as a locking mechanism. This decreases the possibility that the socket 3 is unmated, thereby improving the resistance to the placement of the electrical wires 4.

Further, instead of the configuration such that as the socket 3 is moved downward, the lower rear protrusions 320*b* ride over the base rear projections 230 and then are positioned below the base rear projections 230, respectively, this embodiment is configured so that the lower rear protrusions 320*b* are respectively positioned below the base rear projections 230 by moving rearward the socket 3 inclined with respect to the substrate. Therefore, it is not necessary to elastically deform the base rear projections 230 in the mating process. This allows each base rear projection 230 to have a larger thickness in the up/down directions. Therefore, even if the lower rear protrusions 320*b* are moved upward after mating is completed and then respectively brought into contact with the base rear projections 230, it is less likely that the base rear projections 230 are elastically deformed, which decreases the possibility that the socket 3 is unmated. This further improves the resistance to the placement of the electrical wires 4.

Further, as shown in FIG. 8A, in the mated state, the ridge leading end protrusions 341 formed on the ridges 340 of the socket 3 are respectively positioned below the base front projections 240 formed on the inner surfaces 2111 and 2122 of the base side walls 211 and 212. Therefore, even if the socket 3 is displaced in the right/left directions and thereby the portion near the front end of the socket 3 is subjected to a force which moves the portion upward, each ridge leading end protrusion 341 and the corresponding base front projection 240 are engaged with each other to function as a locking mechanism, and this decreases the possibility that the socket 3 is undated. That is, at the portion near the front end of the socket 3, improved is the ability to maintain the socket 3 mated with respect to the direction in which the two socket side walls 311 and 312 oppose each other (i.e., in the right/left directions).

Likewise, as shown in FIG. 8B, in the mated state, the ridge rear protrusions 342 formed on the ridges 340 of the socket 3 are respectively positioned below the base middle projections 250 formed on the inner surfaces 2111 and 2122 of the base side walls 211 and 212. Therefore, even if the socket 3 is displaced in the direction in which the electrical wires 4 come out (i.e., in the front/rear directions) and thereby the portion near the front end of the socket 3 is subjected to a force which moves the portion upward, each ridge rear protrusion 342 and the corresponding base middle projection 250 are engaged with each other to function as a locking mechanism, and this decreases the possibility that the socket 3 is unrelated. That is, at the portion near the front end of the socket 3, improved is the ability to maintain the socket 3 mated with respect to the front/rear directions.

As described above, the thickness of each lower rear protrusion 320*b* in the up/down directions decreases toward the rear direction, and the top surface of each lower rear protrusion 320*b* is inclined down toward the rear direction. A region of the top surface of each lower rear protrusion 320*b* which region is closest to the vertical protrusion 320*a* is a horizontal surface. Further, the entire under surface of each base rear projection 230 is a horizontal surface. Therefore, if, in the mated state shown in FIG. 6D, the electrical wires 4 are placed to extend upward with the result that the socket 3 is moved upward, the entire top surface of each lower rear protrusion 320*b* is not brought into contact with the under surface of the corresponding base rear projection 230, but only the above-described, horizontal region of the top surface of each lower rear protrusion 320*b* is brought into contact with the under surface of the corresponding base rear projection 230. Thus, each lower rear protrusion 320*b* is engaged with the corresponding base rear projection 230. The engagement area between these members extends rearward from the front end of the under surface of the base rear projection 230, and the length of the engagement area in the front/rear directions is equal to the length of the horizontal region of the top surface of the lower rear protrusion 320*b* in the front/rear directions.

In FIG. 7, the area of each reinforcing metal fitting 216 with respect, to the front/rear directions is indicated with R1, and the engagement area between each lower rear protrusion 320*b* and the corresponding base rear projection 230 with respect to the front/rear directions is indicated with R2. As apparent from this figure, R1 encompasses R2 in this embodiment. That is, with respect to the front/rear directions, the engagement area between each lower rear protrusion 320*b* and the corresponding base rear projection 230 is encompassed by the area of the corresponding reinforcing metal fitting 216. Because of this, even if the electrical wires 4 are displaced upward, it is less likely that the base housing 21 engaged with the socket housing 31 is warped, and this prevents the base rear projection(s) 230 or the lower rear protrusion(s) 320*b* from being deformed or broken by a force smaller than the strength of soldering connection of the reinforcing metal fittings 216. This consequently prevents the electrical wires 4 from being easily released by deformation of the socket housing 31 or the base housing 21. This further improves the resistance to the placement of the electrical wires 4.

To the above-described embodiment, various design changes are possible. For example, it is possible to change, as needed, the shape of the socket, and the base, the shape, number, location of the contacts, the number and arrangement direction of the electric wires, and the shape and location of the first to third protrusions, the first to third, engagement projections, and the like. For example, in the above-described embodiment, the leading end of each base rear projection 230 and the leading end of the lower rear protrusion 320*b* are both flat surfaces; however, at least one of them does not have to be the flat surface. In this case, in order that each base rear projection 230 and the corresponding lower rear protrusion 320*b* respectively have portions vertically overlap each other in the mated state, the condition that "the distance between the respective leading ends of the first engagement projections is smaller than the respective leading ends of the first protrusions" shall mean that "at least in a region where each first, engagement projection and the corresponding engagement, projection are at the same position with respect to the front/rear directions, the distance between the respective leading ends of the first engagement projections is smaller than the respective leading ends of the first protrusions."

Further, in the above-described embodiment, the rear side surfaces 340*b* of the ridges 340 are respectively brought into contact with the frontward-facing surfaces 2112 and 2122 of the rear regions 211*a* and 212*a* when the socket 3 is moved rearward until the lower rear protrusions 320*b* respectively positioned below the base rear projections 230. However, the present invention is not limited to this. For example, the rearward-facing surfaces 321 of the vertical protrusions 320*a* may be respectively brought into contact with the front end surfaces 230*a* of the base rear projections 230. Alternatively, the following structure is also possible: the rearward-facing surfaces 321 of the vertical protrusions 320*a* are respectively brought into contact with the front end surfaces 230*a* of the base rear projections 230; and the rear side surfaces 340*b* of the ridges 340 are respectively brought into contact with the frontward-facing surfaces 2112 and 2122 of the rear regions 211*a* and 212*a*. That is, various structures are possible as long as the two socket side walls 311 and 312 respectively have abutting surfaces which are configured to be respectively brought into contact with frontward-facing surfaces of the base side walls 211 and 212 when the socket 3 is moved rearward as shown in FIGS. 6B and 6C. Meanwhile, such abutting surfaces may be omitted.

In the above-described embodiment, each ridge 340 is provided with the ridge leading end protrusion (the second protrusion) 341 and the ridge rear protrusion (the third protrusion) 342; however, the ridge rear protrusions 342 and the base middle projections (the third engagement projections) 250 to be respectively engaged therewith may be omitted. In this case, instead of providing the ridges 340, the ridge leading end protrusions 341 may be provided on the socket side walls 311 and 312, respectively. Further, the ridge leading end protrusions 341 and the base front projections (the second engagement projections) 240 to be respectively engaged therewith may be omitted.

In the above-described embodiment, the inner surfaces 2111 and 2121 of the base side walls 211 and 212 respectively include the rear regions 211*a* and 212*a*, on each of which the base rear projection (the first engagement projection) 230 is formed, and respectively include the front regions 211*b* and 212*b*. However, in the case where the ridges 340 are not provided, the inner surfaces 2111 and 2121 of the base side walls 211 and 212 may be flat surfaces without the front regions 211*b* and 212*b* and the rear regions 211*a* and 212*a*.

In the above-described embodiment, each lower rear protrusion 320*b* is slightly separated from the corresponding base rear projection 230 with respect to the up/down directions in the mated state; however they may be in contact with each other in the mated state. Further, as long as the engagement area between each lower rear protrusion 320*b* and the corresponding base rear projection 230 at least partially overlaps, with respect to the front/rear directions, the area of the corresponding reinforcing metal fitting 216, the resistance to the placement of the electrical wires 4 is further improved. However, it is preferable that R1 encompasses R2, as is in the above described embodiment.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An electrical connector comprising:

a base including a base housing which is configured to be mounted on a substrate and is made of an insulating material, and a base contact attached to the base housing; and a socket including a socket housing made of an insulating material, and a socket contact attached to the socket housing, wherein:

the socket housing includes two socket side walls parallel to each other, each of which walls extends in one direction, and the socket housing is configured to hold an electric wire so that the electric wire connected to the socket contact comes out of a rear end of the socket housing in the one direction;

the base housing includes two base side walls parallel to each other, each of which walls is orthogonal to the substrate and extends in the one direction, and a socket accommodation chamber formed between the two base side walls and opening rearward and upward, which is a direction away from the substrate, to accommodate the socket;

each of the two socket side walls of the socket housing is provided with a first protrusion, and a distance between the two base side walls is equal to or larger than a distance between respective leading ends of the first protrusions;

each of the two base side walls is provided with, on its inner surface, a first engagement projection, and a distance between respective leading ends of the first engagement projections is smaller than the distance between the respective leading ends of the first protrusions and is equal to or larger than a distance between the two socket side walls; and the electrical connector is configured so that after the socket is inserted into the socket accommodation chamber from above with the first protrusions positioned forward of the first engagement projections, to be partially accommodated in the socket accommodation chamber while being inclined with respect to the substrate, the socket is moved rearward until each first protrusion is positioned below the corresponding first engagement projection, and then the socket is displaced in a direction in which a front end of the socket is moved downward, thereby causing the socket to be completely accommodated in the socket accommodation chamber and establishing electrical connection between the socket contact and the base contact.

2. The electrical connector according to claim 1, wherein each of the two socket side walls is provided with an abutting surface configured to be brought into contact with a corresponding one of frontward-facing surfaces of the base side walls when the socket partially accommodated in the socket accommodation chamber while being inclined with respect to the substrate is moved rearward until each first protrusion is positioned below the corresponding first engagement projection.

3. The electrical connector according to claim 1, wherein:

each of the two socket side walls is provided with a second protrusion located forward of the first protrusion, and each of the two base side walls is provided with, on its inner surface, a second engagement projection located forward of the first engagement projection; and the electrical connector is configured so that, when the socket is displaced in the direction in which the front end of the socket is moved downward, each second protrusion rides over the corresponding second engagement projection, thereby causing each second protrusion to be positioned below the corresponding second engagement projection while the socket is completely accommodated in the socket accommodation chamber.

4. The electrical connector according to claim 3, wherein:

each of the inner surfaces of the two base side walls includes a rear region on which the first engagement projection is formed, and a front region on which the second engagement projection is formed, the front region being recessed relative to the rear region;

each of the two socket side walls is provided with a ridge located forward of the first protrusion, and the second protrusion is formed on a surface of the ridge which surface opposes the corresponding one of the base side walls and a third protrusion is formed on a rearward-facing surface of the ridge;

a third engagement projection is formed on a frontward-facing surface provided at a front end of the rear region; and the electrical connector is configured so that, when the socket is displaced in the direction in which the front end of the socket is moved downward, each third protrusion rides over the corresponding third engagement projection, thereby causing each third protrusion to be positioned below the corresponding third engagement projection while the socket is completely accommodated in the socket accommodation chamber.

5. The electrical connector according to claim 1, wherein;

a reinforcing metal fitting configured to be used to mount the base on the substrate is attached to each of the two base side walls; and an engagement area, which is an area where each first protrusion is brought into contact with the corresponding first engagement projection, at least partially overlaps a substrate-facing area of the reinforcing metal fitting with respect to front/rear directions.

* * * * *